US010322782B1

(12) United States Patent
Brown et al.

(10) Patent No.: US 10,322,782 B1
(45) Date of Patent: Jun. 18, 2019

(54) COMBINED AUTONOMOUS UNDERWATER VEHICLE AND BUOY DEVICE

(71) Applicant: SPAWAR Systems Center Pacific, San Diego, CA (US)

(72) Inventors: Michael Hunter Brown, San Diego, CA (US); Nicholas Ray Caruso, San Diego, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 0 days.

(21) Appl. No.: 16/137,838

(22) Filed: Sep. 21, 2018

(51) Int. Cl.

| | |
|---|---|
| ***B63G 8/00*** | (2006.01) |
| ***B63G 8/22*** | (2006.01) |
| ***B63B 22/20*** | (2006.01) |
| ***B63G 8/20*** | (2006.01) |

(52) U.S. Cl.
CPC ..... *B63G 8/001* (2013.01); *B63B 22/20* (2013.01); *B63G 8/20* (2013.01); *B63G 8/22* (2013.01); *B63G 2008/004* (2013.01)

(58) Field of Classification Search
CPC ..... B63G 8/001; B63G 8/20; B63G 8/22
See application file for complete search history.

(56) References Cited

U.S. PATENT DOCUMENTS 4,189,703 A * 2/1980 Bennett ..... B63B 22/003 114/254
4,330,895 A * 5/1982 Putman ..... G10K 11/006 114/311
6,018,493 A * 1/2000 Buckingham ..... B63B 22/003 367/153
6,056,237 A * 5/2000 Woodland ..... B64C 3/40 244/3.15
7,179,145 B2 * 2/2007 Driscoll ..... B63B 21/243 114/294
8,448,592 B2 * 5/2013 Crowell ..... B63G 8/00 114/322
8,492,692 B2 7/2013 Fisher
8,804,461 B2 * 8/2014 Imran ..... F03B 13/20 367/134
8,813,669 B2 * 8/2014 Race ..... H01Q 1/04 114/244

(Continued)

*Primary Examiner* — S. Joseph Morano
*Assistant Examiner* — Jovon E Hayes
(74) *Attorney, Agent, or Firm* — NIWC Pacific; Kyle Eppele

(57) ABSTRACT

A combined autonomous underwater vehicle and buoy device that may travel underwater in a horizontal orientation as an underwater glider to a desired location and then, at the desired location, move into a vertical orientation and operate as a buoy. The combined autonomous underwater vehicle and buoy device includes an elongated device body having a ballast tank, a plurality of fins, and a deployable weight. While in water, the device body may operate the ballast tank to selectively increase its buoyancy to cause vertical descent and decrease its buoyancy to cause vertical ascent, with the fins generating lift that moves the device body horizontally from this vertical motion. To move to the vertical orientation, the device body may reposition the deployable weight to adjust the center of mass of the device body sufficiently to cause the device body to move from the horizontal orientation to the vertical orientation.

20 Claims, 3 Drawing Sheets

(56) References Cited

U.S. PATENT DOCUMENTS

| | | | | |
|---|---|---|---|---|
| 8,882,555 | B2 * | 11/2014 | Mulligan | B63B 35/00 441/80 |
| 9,321,529 | B1 | 4/2016 | Jones et al. | |
| 9,563,203 | B2 | 2/2017 | Davoodi et al. | |
| 9,849,941 | B2 * | 12/2017 | Huenefeld | B63B 22/18 |
| 2004/0229531 | A1 * | 11/2004 | Driscoll | B63B 21/243 441/23 |
| 2009/0107388 | A1 * | 4/2009 | Crowell | B63C 7/26 114/336 |
| 2010/0212573 | A1 * | 8/2010 | Hawkes | B63B 22/24 114/328 |
| 2012/0170935 | A1 * | 7/2012 | Machado | H04B 13/02 398/58 |
| 2012/0289103 | A1 * | 11/2012 | Hudson | F42B 19/00 440/38 |
| 2014/0026385 | A1 | 1/2014 | Holcomb et al. | |
| 2016/0054097 | A1 * | 2/2016 | Sylvia | B63G 8/001 124/73 |
| 2016/0121983 | A1 * | 5/2016 | Rokkan | B63B 27/16 114/313 |

* cited by examiner

COMBINED AUTONOMOUS UNDERWATER VEHICLE AND BUOY DEVICE

STATEMENT OF GOVERNMENT INTEREST FEDERALLY SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif. 92152; telephone (619) 553-5118; email: ssc_pac_t2@navy.mil. Reference Navy Case No. 103881.

BACKGROUND OF THE INVENTION

Field of the Invention

This disclosure relates generally to a long term oceanic buoy that operates as an autonomous underwater vehicle when being deployed.

Description of the Prior Art

The use of buoys in various aquatic operations is well established. As many buoys are not operative to travel to their desired location on their own, buoys are commonly required to be transported on other vessels to desired location in order to be deployed. As such, a problem which still exists is that deploying buoys and other oceanic monitoring equipment can be extreme costly in ship time and/or ship personnel time.

Thus, there remains a need for a device that allows a user desiring to deploy a buoy in a remote location to merely deploy a combined autonomous underwater vehicle and buoy device from shore and have it navigate to a specified location and then invert and become a stationary buoy.

SUMMARY OF THE INVENTION

The present disclosure describes a combined autonomous underwater vehicle and buoy device (or "combined buoy device") that allows for relatively inexpensive deployments and recoveries of the combined buoy device, as well as easy repositioning if the buoy device drifts out of an area of interest. In accordance with an embodiment of the present disclosure, the combined buoy device comprises a device body having a proximal end and a distal end, wherein said proximal end defines a bow when the device body is in a horizontal orientation and said distal end defines a stern when the device body is in the horizontal orientation; wherein said device body is configured to selectively cause an increase in the buoyancy of the device body so as to cause the device body to descend vertically and to cause a decrease in the buoyancy of the device body so as to cause the device body to ascend vertically; wherein said device body is configured to generate lift that moves the device body horizontally in response to the device body being caused to ascend and descend vertically; and a deployable weight integral with said device body, wherein said deployable weight is selectably moveable from a first position between the bow and stern of the device body to a second position in which the deployable weight is tethered to but outside of the profile of the device body in a manner which causes center of mass of the device body to move sufficiently aft to cause the device body to move from the horizontal orientation to a vertical orientation when in water.

DETAILED DESCRIPTION OF THE INVENTION

Figure 1:
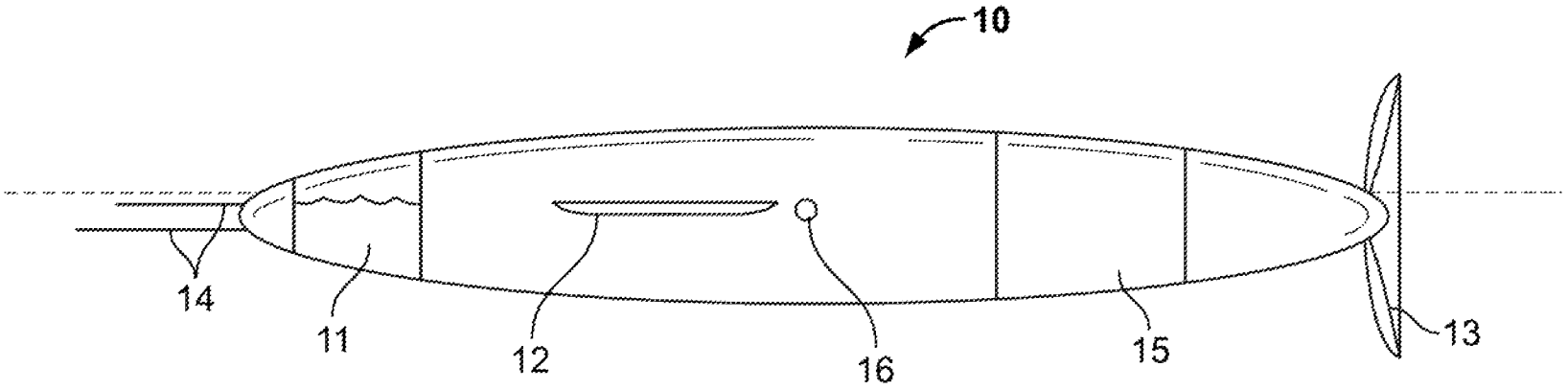
FIG. 1 is a side elevational view of a combined autonomous underwater vehicle and buoy device built in accordance with the present disclosure in a horizontal orientation and its autonomous underwater vehicle configuration while in water.
Figure 2:
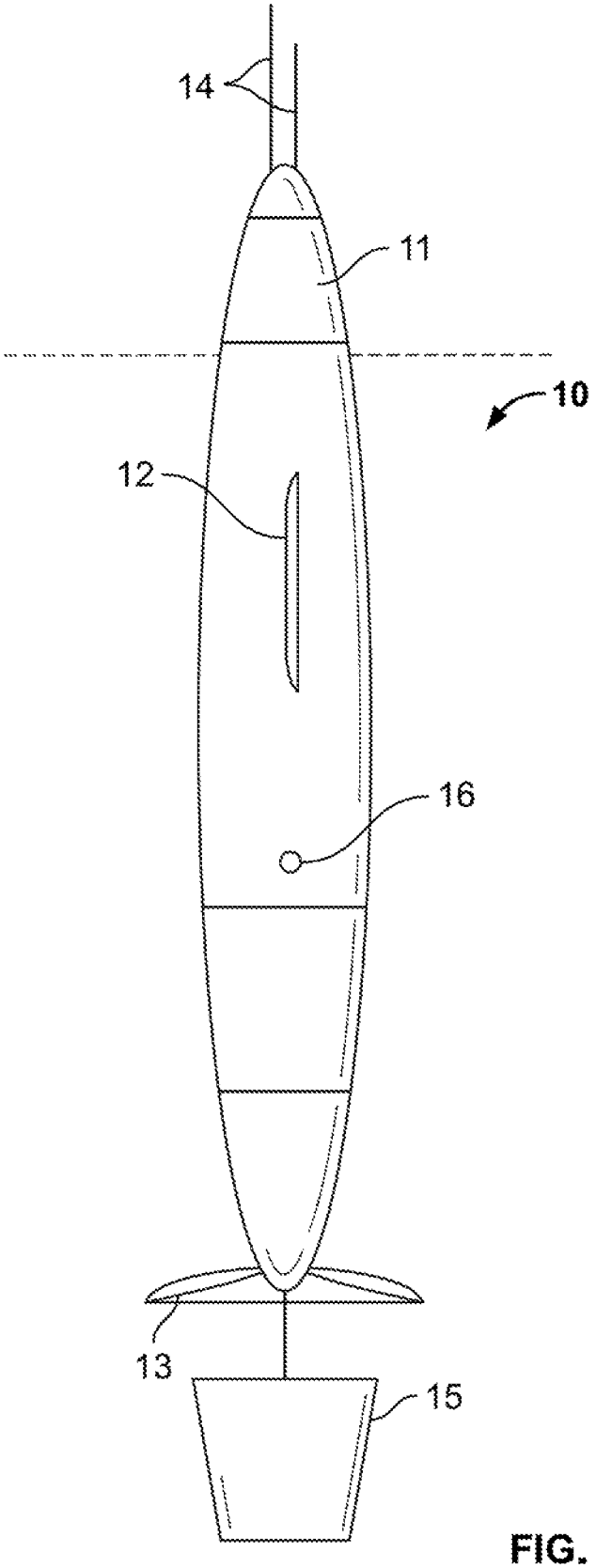
FIG. 2 is a side elevational view of a combined autonomous underwater vehicle and buoy device built in accordance with the present disclosure in a vertical orientation and its buoy configuration while in water.
Figure 3:
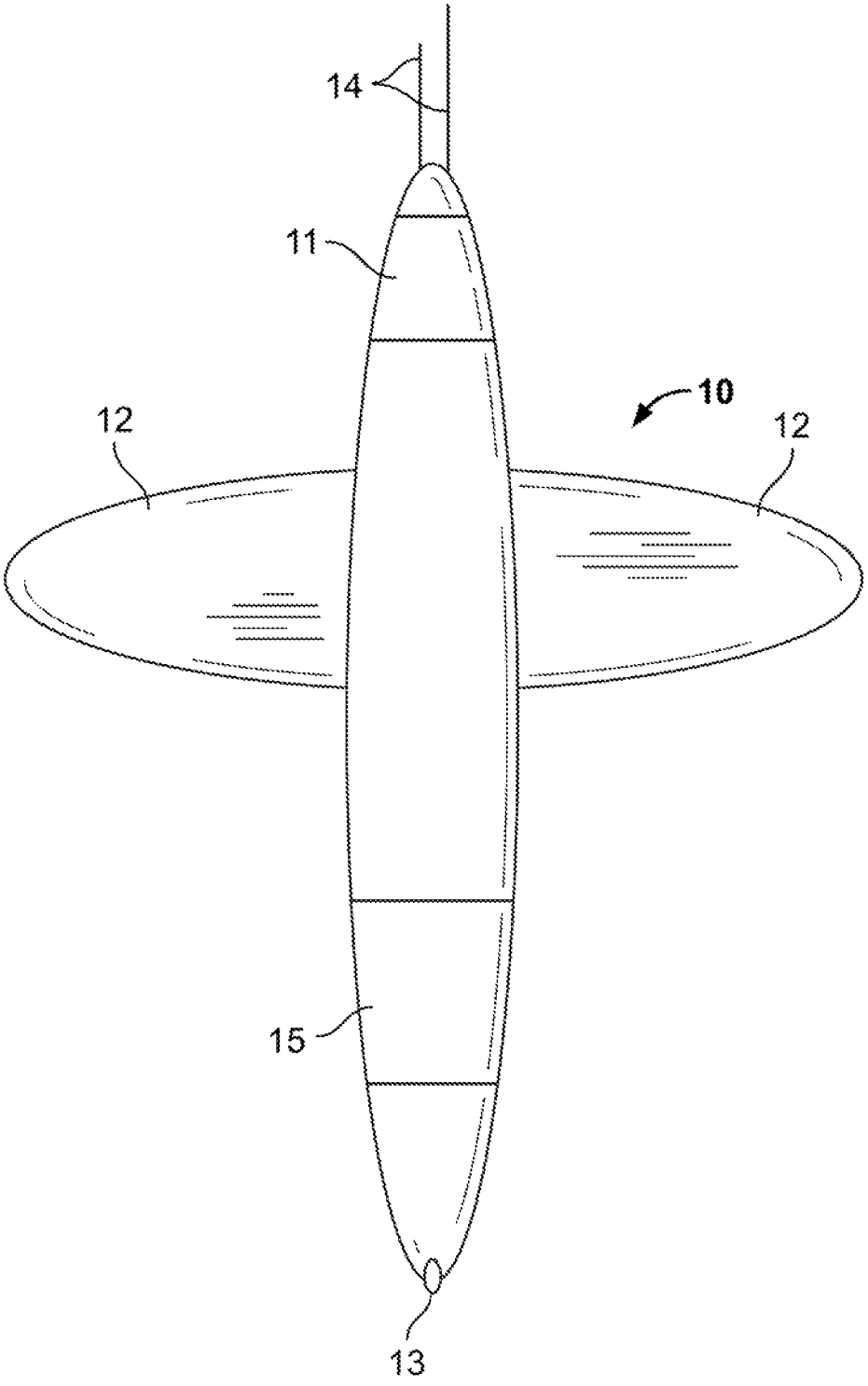
FIG. 3 is a top plan view of a combined autonomous underwater vehicle and buoy device built in accordance with the present disclosure.

Described herein is a combined autonomous underwater vehicle and buoy device that operates to travel underwater in a horizontal orientation that defines an autonomous underwater vehicle configuration as an autonomous underwater vehicle to a desired location and then, once it reaches the desired location, move into a vertical orientation that defines a buoy configuration and operate as a buoy. Referring now to the drawings, and in particular, FIGS. 1, 2 and 3, Applicant's combined autonomous underwater vehicle and buoy device is shown having an elongated, modular device body 10 that operates as a hull and is thus sized, shaped and constructed to travel underwater. The device body 10 includes a proximal end which serves as a bow when the device body is in the horizontal orientation and a distal end which serves as a stern when the device body is in the horizontal orientation. Integral with the device body 10 is a ballast tank 11, a plurality of fins 12 (in this case, a pair of fins), a rudder 13, antennae 14, a deployable weight 15, and an internal control system (not shown).

The ballast tank 11 may be positioned adjacent or otherwise proximal to the bow of the device body 10 and may be configured to increase and decrease buoyancy of the device body 10, thereby causing the device body to either ascend and descend vertically. The ballast tank 11 may include a piston to flood or evacuate its internal space with seawater, with a relatively full tank decreasing buoyancy (causing the device body 10 to descend in the water) and a relatively empty tank increasing buoyancy (causing the device body 10 to ascend in the water).

The combined buoy device when in its autonomous underwater vehicle configuration may operate as an underwater glider and utilize the ascent and descent of the device body 10 generated by the increases and decreases in buoyancy to generate propulsion in the water. In this regard, the fins 12 may operate to generate lift that moves the device body 10 horizontally as the device body 10 is caused to ascend and descend vertically.

The combined buoy device may utilize differences in temperature between the relatively warm surface waters and the relatively cold deeper waters of the ocean to enable propulsion through temperature driven gliding in the same manner as a Slocum thermal glider. Such temperature driven gliding may incorporate a precisely calibrated oil filled bladder (not shown) integral with the device body 10 which would change density in response to temperature changes. In this regard, the changes in temperature would operate to create the increases and decreases in buoyancy used by the fins 12 to generate propulsion in the water.

The rudder 13 is integral with the stern of the device body 10 and is operative to control yawing motion of the device body 10.

The antennae 14 may be defined by one or a plurality of transducer integral with the device body 10. The antennae 14 may extend from the bow of the device body 10, as illustrated in FIGS. 1, 2, and 3. The antennae 14 may alternatively, however, be positioned inside the device body 10.

The deployable weight 15 may be defined as a weighted member which is selectably moveable from a position inside or otherwise flush with the device body 10, as shown in FIG. 1, to a position outside of but still tethered or otherwise connected to the device body 10, as shown in FIG. 2. It is appreciated that the mass of the deployable weight 15 relative to the device body 10 (not including the deployable weight 15) is such that when the deployable weight 15 is moved to a position outside of but still tethered or otherwise connected to the device body 10 while the device body 10 and deployable weight are underwater, the center of mass 16 of the device body 10 will move sufficiently aft to cause the device body 10 to move from a horizontal orientation to a vertical orientation. When in the position outside of but still tethered or otherwise connected to the device body 10, the deployable weight 15 serves as a counterweight that operates to maintain the device body 10 in a vertical orientation.

The device body 10 also may include an internal control system having a battery, a positioning system interface, communications interface that is connected to the antennae 14, and a controller. It is contemplated that the battery is operative to supply electrical power to the controller, positioning system interface, and communications interface, that the positioning system interface may be defined by a global positioning system and the transceiver may be defined by a transceiver. The controller is electrically connected to the positioning system interface, the communications interface, and the rudder 13 and is operative to receive geolocation positioning data from the positioning system interface, communicate electrical signals with remote devices (including remote electronic devices) through the communications interface, and selectively cause the ballast tank 11 to release fluid, and control the positioning of the rudder 13. The controller may further include or be able to access software containing instructions which allow it to determine based on data from the positioning system interface when the device body 10 has reached a target geolocation and, when it has reached the target geolocation, automatically cause the device body 10 to transition from the autonomous underwater vehicle configuration to the buoy configuration.

The device body 10, while still underwater and generally after travelling to a target geolocation as an autonomous underwater vehicle, may transition from the autonomous underwater vehicle configuration to the buoy configuration by adjusting its center of mass 16 to cause the device body 10 to move to a vertical orientation. The center of mass 16 is moved aft by moving the deployable weight 15 to a position outside of but still tethered or otherwise connected to the device body 10 and by emptying the ballast tank 11 of fluid. Once the device body 10 is in the vertical orientation, it is appreciated that the antennae 14 may be raised above the surface of the water.

The tether which connects the deployable weight 15 to the device body 10 may enable the deployable weight 15 to function as a sea anchor or may be sufficiently long to allow the deployable weight 15 to extend to the sea floor and serve as an anchor The deployable weight 15 may additionally include a sensor package so as to allow the combined buoy device to act as a gateway from seafloor sensors to operators onshore and become a spar buoy.

The combined buoy device may be powered by batteries and a propeller in addition or in the alternative to its operation in the same manner as a Slocum thermal glider.

The combined buoy device may additionally include a recovery system which enables the deployable weight 15 to be winched back to and into the device body 10. It is contemplated that such a feature is important for the deployed sensor package and sea floor to surface gateway concept referenced above.

The combined buoy device may additionally include a solar array for recharging its battery (or batteries).

The controller may also be connected to the fins 12 and operative to control the positioning of the fins 12 to adjust the nature of the lift generated from the vertical ascent and descent of the device body 10.

It is contemplated that the combined buoy device may additionally be configured to further adjust its buoyancy capability, by retaining fluid in the ballast tank 11 or otherwise, to cause the device body 10 to sink below the surface of a body of water when it moves to the vertical orientation. In such an implementation, the combined buoy device may await further commands, such as acoustical commands travelling underwater. Advantageously, the combined buoy device could then be used as a gateway node that gathers data from seafloor sensors that is transmitted once it surfaces.

It will be understood that many additional changes in the details, materials, steps and arrangement of parts, which have been herein described and illustrated to explain the nature of the invention, may be made by those skilled in the art within the principle and scope of the invention as expressed in the appended claims.

What is claimed is:

1. A combined autonomous underwater vehicle and buoy device, comprising:

a device body having a proximal end and a distal end, wherein said proximal end defines a bow when the device body is in a horizontal orientation and said distal end defines a stern when the device body is in the horizontal orientation;

wherein said device body is configured to selectively cause an increase in a buoyancy of the device body so as to cause the device body to descend vertically and to cause a decrease in the buoyancy of the device body so as to cause the device body to ascend vertically;

wherein said device body is configured to generate lift that moves the device body horizontally in response to the device body being caused to ascend and descend vertically; and a deployable weight integral with said device body, wherein said deployable weight is selectably moveable from a first position between the bow and stern of the device body to a second position in which the deployable weight is tethered to but outside of a profile of the device body in a manner which causes center of mass of the device body to move sufficiently aft to cause the device body to move from the horizontal orientation to a vertical orientation when in water.

2. The combined autonomous underwater vehicle and buoy device of claim 1, additionally comprising a ballast tank having internal space integral with said device body, wherein said ballast tank is configured to selectively cause the increase in the buoyancy of the device body so as to cause the device body to descend vertically and to cause the decrease in the buoyancy of the device body so as to cause the device body to ascend vertically.

3. The combined autonomous underwater vehicle and buoy device of claim 2, wherein said ballast tank is configured to selectively introduce water into the internal space to decrease in the buoyancy of the device body and to selectively evacuate water from the internal space to increase in the buoyancy of the device body.

4. The combined autonomous underwater vehicle and buoy device of claim 1, additionally comprising at least one fin extending from the device body, wherein said at least one fin is configured to generate lift on the device body in response to the device body being caused to ascend and descend vertically.

5. The combined autonomous underwater vehicle and buoy device of claim 1, additionally comprising a pair of fins extending from opposing sides of the device body, wherein said pair of fins are configured to generate lift on the device body in response to the device body being caused to ascend and descend vertically.

6. The combined autonomous underwater vehicle and buoy device of claim 1, additionally comprising a rudder integral with the device body and operative to control yawing motion of the device body.

7. The combined autonomous underwater vehicle and buoy device of claim 6, wherein the rudder is integral with the stern of the device body.

8. The combined autonomous underwater vehicle and buoy device of claim 1, wherein when the device body is in water and said deployable weight is in the second position, the deployable weight is situated beneath the device body.

9. A combined autonomous underwater vehicle and buoy device, comprising:

a device body having a proximal end and a distal end, wherein said proximal end defines a bow when the device body is in a horizontal orientation and said distal end defines a stern when the device body is in the horizontal orientation;

wherein said device body is configured to selectively cause an increase in a buoyancy of the device body so as to cause the device body to descend vertically and to cause a decrease in the buoyancy of the device body so as to cause the device body to ascend vertically;

wherein said device body is configured to generate lift that moves the device body horizontally in response to the device body being caused to ascend and descend vertically;

a deployable weight integral with said device body, wherein said deployable weight is selectably moveable from a first position between the bow and stern of the device body to a second position in which the deployable weight is tethered to but outside of a profile of the device body in a manner which causes center of mass of the device body to move sufficiently aft to cause the device body to move from the horizontal orientation to a vertical orientation when in water; and an internal control system having positioning system interface and integral with said device body, wherein said internal control system causes the deployable weight to move from the first position to the second position automatically upon determining that the device body has reached a predetermined target geolocation using data from the positioning system interface.

10. The combined autonomous underwater vehicle and buoy device of claim 9, additionally comprising a ballast tank having internal space integral with said device body, wherein said ballast tank is configured to selectively cause the increase in the buoyancy of the device body so as to cause the device body to descend vertically and to cause the decrease in the buoyancy of the device body so as to cause the device body to ascend vertically.

11. The combined autonomous underwater vehicle and buoy device of claim 10, wherein said ballast tank is configured to selectively introduce water into the internal space to decrease in the buoyancy of the device body and to selectively evacuate water from the internal space to increase in the buoyancy of the device body.

12. The combined autonomous underwater vehicle and buoy device of claim 9, additionally comprising at least one fin extending from the device body, wherein said at least one fin is configured to generate lift on the device body in response to the device body being caused to ascend and descend vertically.

13. The combined autonomous underwater vehicle and buoy device of claim 9, additionally comprising a pair of fins extending from opposing sides of the device body, wherein said pair of fins are configured to generate lift on the device body in response to the device body being caused to ascend and descend vertically.

14. The combined autonomous underwater vehicle and buoy device of claim 9, additionally comprising a rudder integral with the device body and operative to control yawing motion of the device body.

15. The combined autonomous underwater vehicle and buoy device of claim 14, wherein the rudder is integral with the stern of the device body.

16. The combined autonomous underwater vehicle and buoy device of claim 9, wherein when the device body is in water and said deployable weight is in the second position, the deployable weight is situated beneath the device body.

17. A combined autonomous underwater vehicle and buoy device, comprising:

a device body having a proximal end and a distal end, wherein said proximal end defines a bow when the device body is in a horizontal orientation and said distal end defines a stern when the device body is in the horizontal orientation;

a ballast tank having internal space integral with said device body, wherein said ballast tank is configured to selectively cause the increase in a buoyancy of the device body so as to cause the device body to descend vertically and to cause the decrease in the buoyancy of the device body so as to cause the device body to ascend vertically;

at least one fin extending from the device body, wherein said at least one fin is configured to generate lift on the device body in response to the device body being caused to ascend and descend vertically;

a rudder integral with the stern of the device body and operative to control yawing motion of the device body;

a deployable weight integral with said device body, wherein said deployable weight is selectably moveable from a first position between the bow and stern of the device body to a second position in which the deployable weight is tethered to but outside of a profile of the device body in a manner which causes center of mass of the device body to move sufficiently aft to cause the device body to move from the horizontal orientation to a vertical orientation when in water; and an internal control system having positioning system interface and integral with said device body, wherein said internal control system causes the deployable weight to move from the first position to the second position automatically upon determining that the device body has reached a predetermined target geolocation using data from the positioning system interface.

18. The combined autonomous underwater vehicle and buoy device of claim 17, additionally comprising at least one antenna integral with the bow of the device body, wherein said internal control system includes a transceiver electrically connected to said antenna so as to enable the internal control system to communicate electrical signals with a remote electronic device.

19. The combined autonomous underwater vehicle and buoy device of claim 18, wherein when the device body is in water and said deployable weight is in the second position, the at least one antenna extends above the surface of the water.

20. The combined autonomous underwater vehicle and buoy device of claim 17, wherein when the device body is in water and said deployable weight is in the second position, the deployable weight is situated beneath the device body.

* * * * *